US011655627B2

(12) United States Patent
Steinbacher et al.

(10) Patent No.: US 11,655,627 B2
(45) Date of Patent: May 23, 2023

(54) LOCKING ELEMENT

(71) Applicant: MEA Bautechnik GmbH, Aichach (DE)

(72) Inventors: Martin Steinbacher, Reicherstein (DE); Wolfgang Zeiselmair, Schrobenhausen (DE)

(73) Assignee: MEA Bautechnik GmbH, Aichach (DE)

( * ) Notice: Subject to any disclaimer, the term of this patent is extended or adjusted under 35 U.S.C. 154(b) by 0 days.

(21) Appl. No.: 17/749,310

(22) Filed: May 20, 2022

(65) Prior Publication Data

US 2022/0372744 A1 Nov. 24, 2022

(30) Foreign Application Priority Data

May 20, 2021 (AT) ..... A 50397/2021

(51) Int. Cl.

| | |
|---|---|
| ***E03F 5/06*** | (2006.01) |
| ***E03F 5/04*** | (2006.01) |
| ***E01C 11/22*** | (2006.01) |
| ***E02D 29/14*** | (2006.01) |

(52) U.S. Cl.

CPC ..... *E03F 5/06* (2013.01); *E01C 11/224* (2013.01); *E02D 29/1427* (2013.01); *E03F 5/041* (2013.01); *E03F 2005/065* (2013.01)

(58) Field of Classification Search

CPC ..... E03F 5/0401; E03F 5/0404; E03F 5/041; E03F 5/06; E03F 2005/065; E03F 2005/056; E03F 2005/066; E01C 11/224; E01C 11/227; E02D 29/1427

USPC .... 210/163, 164, 170.03, 541, 747.3; 404/2, 404/4, 5, 25; 70/163, 166

See application file for complete search history.

(56) References Cited

U.S. PATENT DOCUMENTS

| | | | | |
|---|---|---|---|---|
| 4,621,939 | A * | 11/1986 | Thomann | E01C 11/227 210/164 |
| 4,883,394 | A * | 11/1989 | Van der Woude | E03F 5/06 52/180 |
| 5,437,516 | A * | 8/1995 | Sauerwein | E02D 29/1427 404/2 |
| 6,945,733 | B2 * | 9/2005 | Rathmann | E03F 5/06 210/163 |
| 2008/0295236 | A1 * | 12/2008 | Eichler | E03F 5/0404 4/292 |

FOREIGN PATENT DOCUMENTS

| | | | |
|---|---|---|---|
| EP | 0248427 | A2 | 12/1987 |
| EP | 0594468 | A1 | 4/1994 |
| EP | 2045407 | A1 | 4/2009 |

* cited by examiner

*Primary Examiner* — Christopher Upton

(74) *Attorney, Agent, or Firm* — Rothwell, Figg, Ernst & Manbeck, P.C.

(57) ABSTRACT

The invention relates to a locking element (11) for securing a grate (3). The locking element (11) comprises a spring element (113) kept between a cover element (111*a*) and a spring support element (117). The spring support element (117) is displaceable relative to the cover element (111*a*) by means of an actuating element (115). The displacement of the spring support element (117) causes a movement of at least one of the ends (113*a*, 113*b*) of the spring element (113) relative to the cover element (111*a*).

13 Claims, 3 Drawing Sheets

LOCKING ELEMENT

CROSS REFERENCE TO RELATED APPLICATIONS

This application claims priority from Austrian Patent Application No. A50397/2021, filed May 20, 2021, which is incorporated by reference herein in its entirety.

DESCRIPTION

The invention relates to a locking element according to claim 1 and a drainage system comprising such a locking element.

Known drainage systems often comprise a grate in addition to a channel body in order to align the drainage channel to the surrounding ground level. Such grates are usually simply placed on the channel body. While lateral displacement of the grate transverse or oblique to the longitudinal axis of the drainage channel is prevented by steps, the grate can be removed comparatively easily upwards. This is particularly disadvantageous in public areas, as theft or vandalism can occur, where the grate is then removed.

A locking element for securing a grate used to cover a channel is known from document DE 103 37 263 B. Here, it is disclosed that a resilient locking element is biased by the grate by means of a screw guided through the grate in such a way that a central region of the locking element adopts a maximum distance from the grate. Ends of the resilient locking element are thereby received in recesses provided in inner walls of the channel below the grate. Due to biasing, the ends of the locking element get pressed into the recesses in such a way that the grate, which is connected to the locking element via the screw, can only be removed from the channel after the screw has been removed.

There is a need for an improved locking element to protect grates in channels from theft and vandalism.

The locking element according to the invention comprises a spring element kept between a cover element and a spring support element. The spring support element is displaceable relative to the cover element by means of an actuating element. The displacement of the spring support element causes a movement of at least one of ends of the spring element relative to the cover element.

Due to the spring support element, which is actuated for locking, a locking element can therefore be provided and locked independently of a grate if a drainage system is installed in places accessible to the public. In a case where a drainage system is not accessible to the public, the locking system can be saved without the need to adapt the other components such as grate and channel of the drainage system. This saves manufacturing and storage costs for different components that would otherwise be required.

The cover element can have a planar and elongated shape. A main component of the moving direction of the at least one end of the spring element is parallel to a longitudinal direction of the cover element.

Thus, at least one end or both ends of the spring element can move substantially parallel to the cover element when the actuating element is actuated, i.e. come out from the region covered by the cover element. Upon reverse actuation of the actuating element, the one end or both ends of the spring element can retract again.

The spring element is preferably a leaf spring which, on a side defined as the underside, is in abutment against the spring support element at least in a central region of the leaf spring. On a side defined as the upper side, the leaf spring is in abutment against end edges of the cover element in the region of the ends.

A leaf spring with a predetermined curvature basically has a curvature which, in a completely relaxed state of the leaf spring, causes the central region of the leaf spring in abutment with the spring support element to adopt a maximum distance from the cover element. In this case, a longitudinal extension of the end(s) of the spring element in the longitudinal direction of the cover element within the edges or beyond the edge(s) of the cover element is also at its minimum. In such a state, the locking element can be easily installed or removed.

The leaf spring can also be installed in reverse upside down, namely in such a way that the central region of the spring element is in abutment with the cover element and the ends of the spring element are in abutment against the spring support element.

Instead of a leaf spring with a predetermined curvature, a leaf spring that is easier to manufacture and has no predetermined curvature can alternatively be used. This spring is curved by placing its ends between two counterparts. The curvature can be adjusted depending on the distance between the counterparts.

The spring support element and the spring element can be located between two side walls which, when viewed in the longitudinal direction seen together with the cover element, correspond to a cross-section of a C-profile.

A profile with such a cross-section is easy to obtain as a semi-finished product and, due to a high flexural rigidity, offers great advantages with regard to the intended use.

The spring support element can be in abutment against the two side walls, whereby rotation of the spring support element is prevented.

When an elongated spring support element is used, the side walls as protection against rotation ensure that the relative position of the spring support element to the spring element is maintained at all times. This ensures stability of the locking element as a whole and, in particular, during retraction and coming out of the ends of the spring element.

The actuating element can be formed as a screw which is in thread engagement with the spring support element. This configuration allows the spring support element to be displaced towards or away from the cover element by screwing the screw in or out as actuation of the same.

When a leaf spring is used as a spring element, which is in abutment against the spring support element in its central region with its one side defined as the underside, this advantageously results in the underside of the leaf spring coming into abutment against the spring support element with an increasingly larger area when the spring support element is moved towards the cover element, i.e. when the leaf spring is tensioned. Thus, in the course of actuating the actuating element, whereby tensioning of the spring takes place, the spring rigidity of the portions of the leaf spring not yet in abutment with the spring support element is increased. This applies in particular to the ends of the leaf spring projecting beyond the end edges of the cover element. The ends of the leaf spring are thus given increased rigidity. This makes it more difficult to forcibly remove the locking element when the ends of the leaf spring each engage in a recess on an inner wall of a channel body.

Furthermore, supporting the leaf spring with the spring support element ensures that the leaf spring is prevented from snapping over, which could possibly occur in particular due to the central part of the leaf spring being provided with the bore.

At least one of the cover element, the side walls and the spring support element can be formed of a plastic material.

Surprisingly, it became apparent that, in addition to ferrous or non-ferrous metals, thermoplastics and thermoset plastics (duroplast) with or without fiber reinforcement are also suitable as materials. This applies in particular to a spring support element that can be displaced towards and away from the cover element.

In this case, the spring support element can have a thickening on a side facing away from the spring element, and the actuating element can be formed as a screw. The screw can be in thread engagement with a counterpart embedded in the spring support element in the region of the thickening.

Furthermore, a protrusion can be formed on the side of the cover element facing the spring element, the protrusion serving as a stop for the spring element. The protrusion allows limiting a biasing force of the spring element. This is achieved by the spring element coming into abutment against the protrusion.

The locking element can advantageously be used in a drainage system. Such a drainage system can comprise a drainage channel body formed in a U-shape, when viewed in cross-section, with a bottom and two lateral walls as legs of the U. At a lateral end of a leg opposite from the bottom, a recess is formed on a side facing a second leg, which is defined as an inner side. Furthermore, the drainage system can comprise a grate in abutment with the lateral end and having, when viewed in cross-section, at one end a mounting bracket having a convex portion received in the recess of the channel body. For protection against unauthorized removal of the grate, the drainage system can further have a locking element as described above. In this regard, an end of the spring element can be engaged with a recess formed by the convex portion on the inner side of the mounting bracket.

According to this embodiment of a drainage system, the grate is connected in a form-fit manner to the recess on the inner side of the wall of the drainage body via the bracket. However, due to an elasticity of the bracket, the grate can be removed from the drainage channel body comparatively easily with little effort. This can be prevented by the locking element. For this purpose, the end of the spring element is inserted into the recess formed by the convex portion of the mounting bracket. After inserting the grate with the locking element, the actuating element is actuated so that the resulting displacement of the spring support element presses the end of the spring element firmly into the recess formed by the convex portion of the mounting bracket. Thus, when an attempt is made to remove the grate, the compressive force of the spring element prevents the elastic bracket from springing back, which is why the convex portion of the bracket reliably remains in the recess. This prevents a removal of the grate from the drainage channel body.

Advantageously, the actuating element can be spaced from a side of the grate facing the bottom of the drainage channel body by means of a gap.

In such an embodiment, a tool is required to actuate the actuating element through the grate. According to such an embodiment, removal of the grate without a tool is impossible, such as in a case of vandalism or random theft.

Furthermore, an end edge having a convex portion can be provided at a lateral end of the drainage channel body. The convex portion is thereby received in the recess of the channel body. Therefore, in this case, the convex portion of the mounting bracket is received in a recess formed by the convex portion of the end edge on the inner side.

The end edge improves the stability of the entire system and facilitates accurate positioning of the grate.

A method of attaching a grate to a drainage channel body having a recess at a lateral end of a wall on a side facing a second wall, which is defined as an inner side, comprises the following steps:

- attaching an end edge to the lateral end of a wall opposite a bottom by embracing the lateral end, wherein a convex portion of the end edge is engaged with the recess of the channel body on the inner side of the wall;
- providing a grate having a mounting bracket with a convex portion at one end, when viewed in cross-section, with a locking element, as described above. An end of the spring element is thereby engaged with a recess formed by the convex portion on the inner side of the mounting bracket;
- abutting the grate with the end edge. The convex portion of the mounting bracket is thereby received in a recess formed by the convex portion of the end edge on the inner side;
- actuating the actuating element, preferably by means of a tool through the grate, to displace the spring support element relative to the cover element in order to press an end of the spring element into the recess formed on the inner side of the mounting bracket.

An advantage of the locking system according to the invention is its arrangement below a grate. Apart from the fact that direct access is only possible by means of a suitable tool through the grate, the mechanism and the functioning of the locking element cannot be revealed to an unauthorized person, because it cannot be recognized through the grate and due to the cover element.

Further advantages of the invention will become apparent from the following description of a presently preferred embodiment, which is provided with reference to the accompanying Figures. The Figures show the following:

FIG. 1*a* shows a cross-sectional view of a drainage system comprising a locking element according to the invention.

FIG. 1*b* shows an enlargement of a detail of FIG. 1*a* marked with A and indicated by means of a dash-dot line.

Figure 5A:
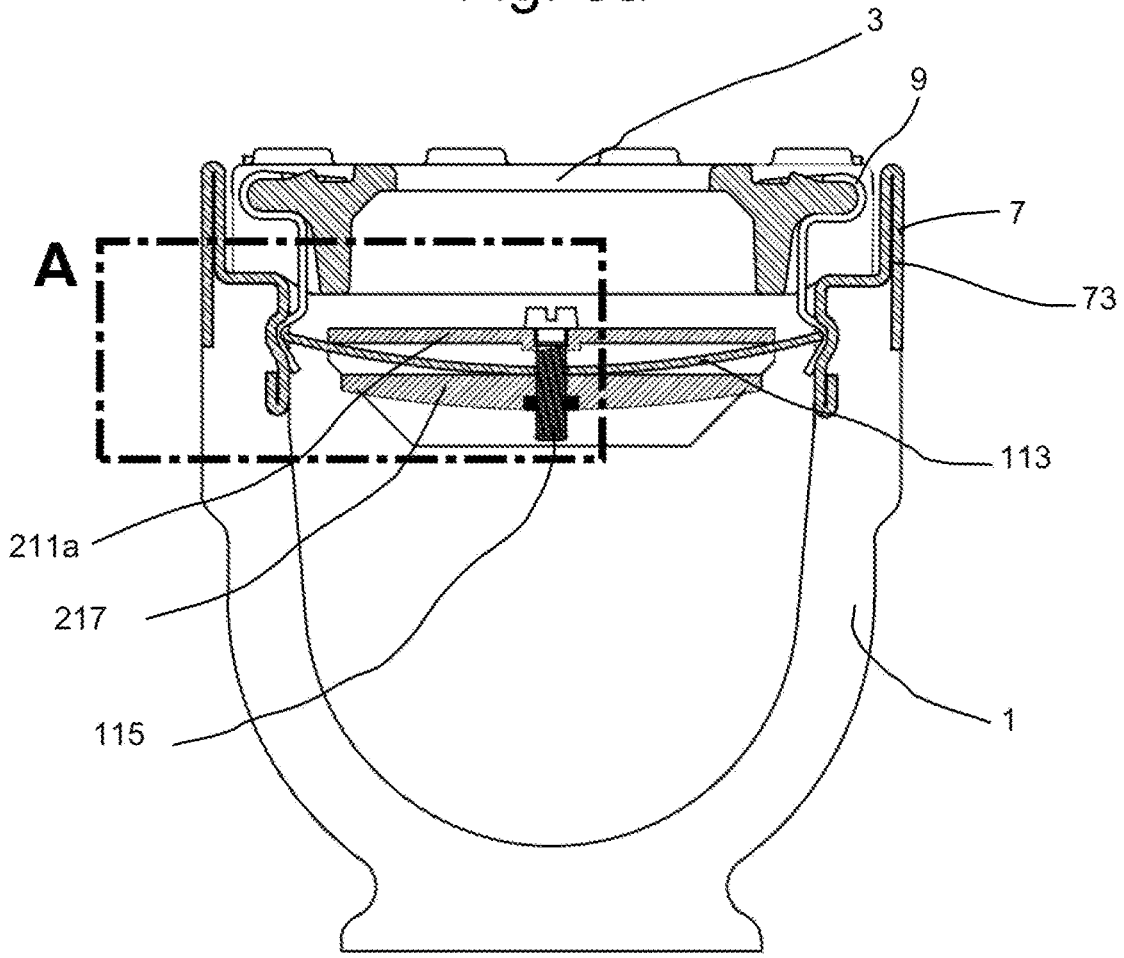

FIG. 5*a* shows a cross-sectional view of a drainage system comprising a locking element according to a modification of the invention.

Figure 5B:
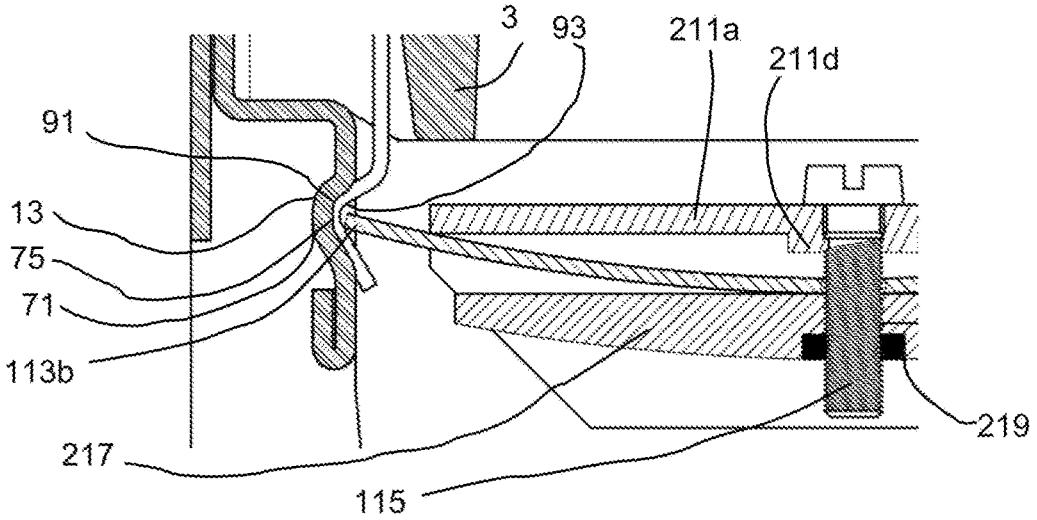

FIG. 5*b* shows an enlargement of a detail of FIG. 5*a* marked with A and indicated by means of a dash-dot line.

A preferred embodiment of the invention is described with reference to FIGS. 1*a* to 4.

The drainage system comprises a drainage channel 1, which is made, for example, of concrete, a plastic or a metal. The drainage channel 1 is substantially U-shaped in cross-section and basically has a bottom and two side walls. The side walls thereby form legs of the U. Each side wall has a recess 13 on its side (inner side) facing the opposite side wall at its end opposite the bottom. The recess 13 is formed in the wall at regular distances by means of a tool. Alternatively, however, a recess can also be formed which extends continuously in the longitudinal direction of the drainage channel 1.

In addition, each of the ends of the drainage channel 1 opposite the bottom is provided with an edge 7. Said edge has, in cross-section, approximately a shape of a chair and embraces the end on both sides with the portions corresponding to the legs of the chair. According to the embodiment, the edge 7 is formed by folding a metal sheet, whereby the edge portion 73 corresponding to the back of the chair is double-walled. The edge 7 serves as a protection for the end of the drainage channel 1, and also serves as a guide for receiving a grate 3.

In addition, the edge has a convex portion 71 at its portion corresponding to the inner leg of the chair. The convex portion 71 is received in the recess 13 when the edge is in the mounted state. Furthermore, a recess 75 is formed in the edge by the convex portion 71 on the opposite side of the portion corresponding to the inner leg of the chair.

Since the material of the edge 7 has resilient properties, the convex portion 71 of the edge 7 is engaged with the recess 13 of the drainage channel 1 after the edge is mounted at the end of the drainage channel 1. Removal of the edge 7 is possible after mounting, but requires overcoming the frictional force prevailing between the convex portion 71 of the edge 7 and the recess 13, as well as the spring force of the edge 7.

The aforementioned grate 3 extends in cross-section opposite from the bottom of the drainage channel 1 between the two portions 73 of the edge 7. The grate 3 can assume any configuration. According to the embodiment, it is a grate made of a sheet material with slits arranged transversely to the longitudinal direction of the grate 3.

At each lateral end of the grate 3 a bracket 9 is arranged, which is directed towards the bottom of the drainage channel 1 in the mounted state of the grate 3. The portion of the bracket 9 projecting towards the bottom of the drainage channel 1 has a convex portion 91 which, like the convex portion 71 of the edge, is directed outwards in the mounted state. The convex portion 91 of the bracket 9 is received in the recess 75 of the edge 7 formed due to the convex portion 71 of the edge 7. The material of the bracket 9 has resilient properties. Therefore, the grate 3 is secured by the bracket 9 via the convex portion 91 thereof, since the convex portion 91 is received in the recess 75 of the edge 7 by means of frictional and form fit engagement.

Due to the convex portion 91 of the bracket 9, a recess 93 is formed on the inner side of the bracket 9. Since a bracket 9 is provided on each side of the grate 3, their recesses 93 face each other.

Before inserting the grate 3, a locking element 11 described below is inserted between the brackets 9.

Figure 1A:
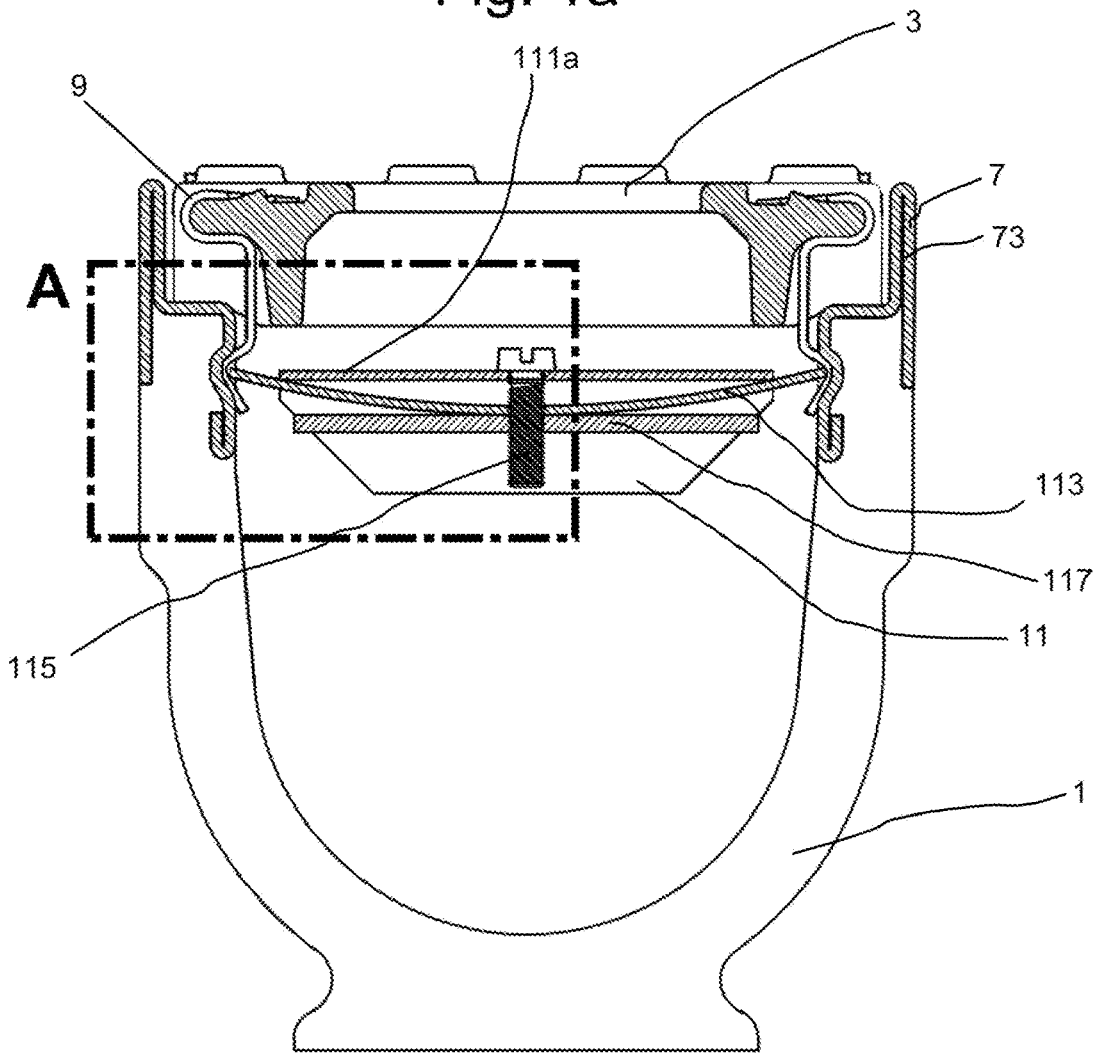
Figure 1B:
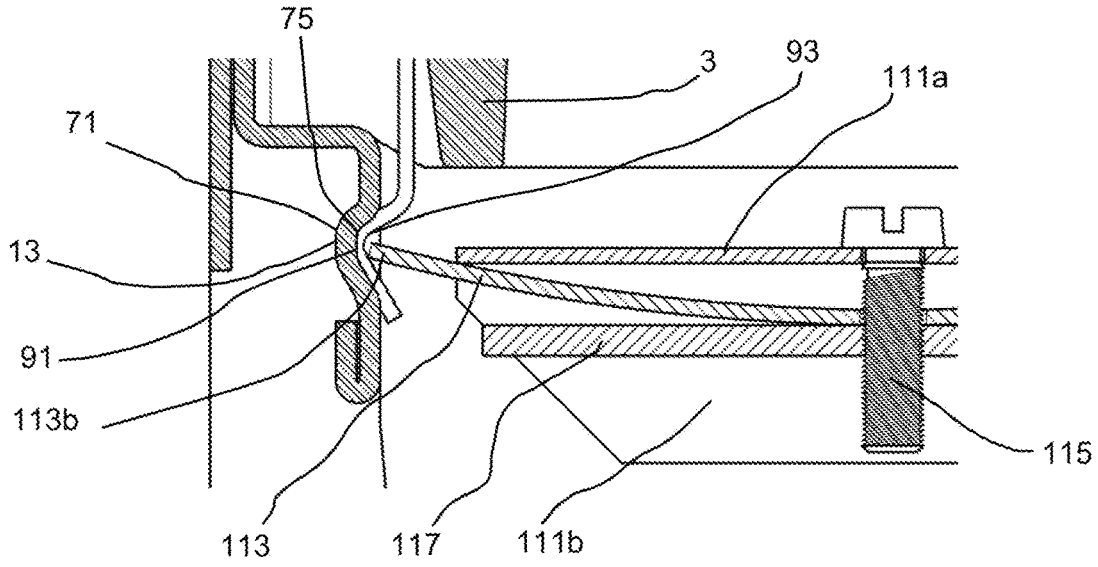
Figure 2:
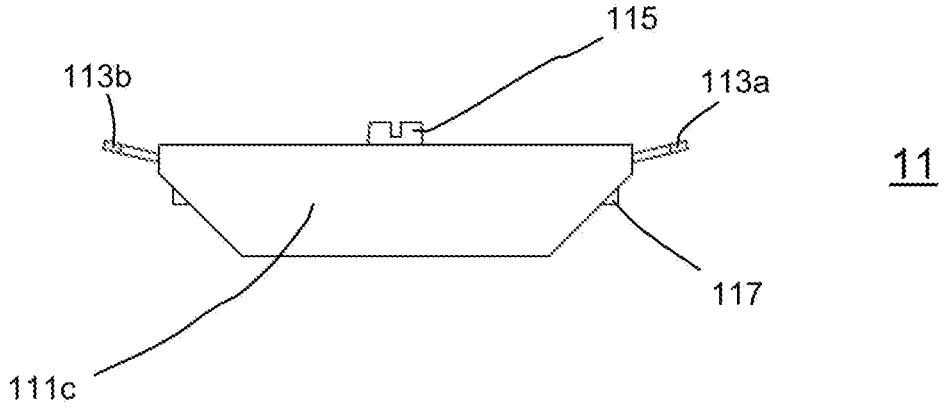
FIG. 2 shows a front view of a locking element according to the invention.
Figure 3:
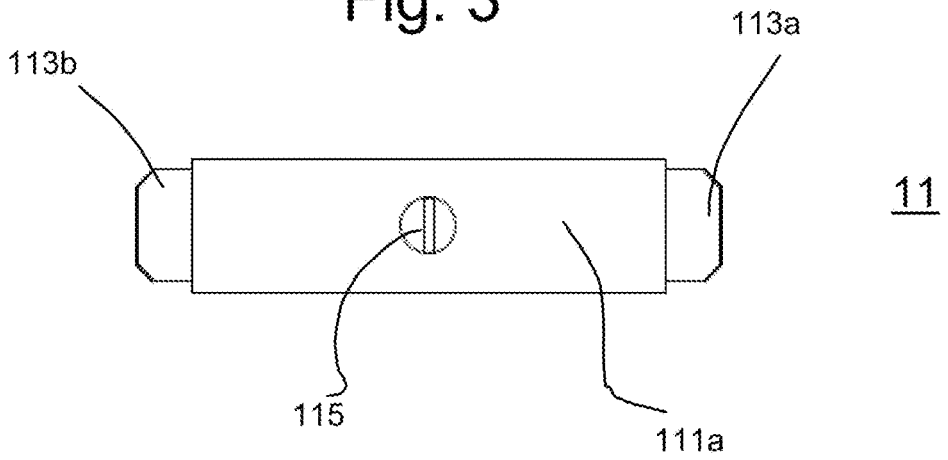
FIG. 3 shows a plan view of the locking element according to the invention.
Figure 4:
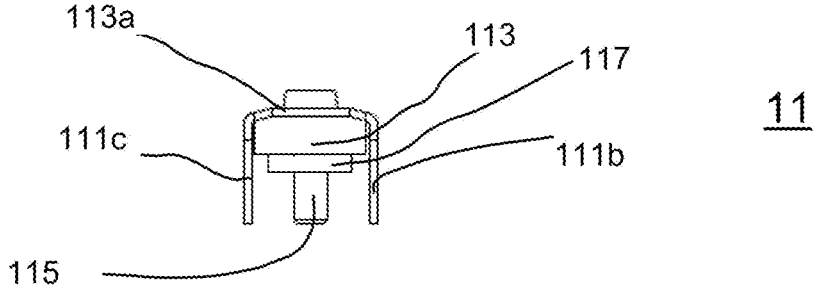
FIG. 4 shows a side view of the locking element according to the invention.

The locking element 11 is described in more detail with reference to FIGS. 2 to 4. The locking element 11 has a base body which is made from a C-profile as a semi-finished product. Two side parts 111*b* and 111*c* are connected by means of a cover part 111*a*. In the installed position, the cover part 111*a* faces the grate 3. Therefore, for the sake of simplicity, in the following description, positional indications such as top and bottom refer to the locking element in this installation position, in which the cover part 111*a* facing the grate 3 is in the uppermost position. The cover part 111*a* corresponds to a cover portion according to the invention.

Below the cover part 111*a*, a leaf spring 113 is arranged which is curved in such a way that its central portion is spaced apart from the cover part 111*a* and its ends 113*a* and 113*b* are located at approximately the same level as the cover part 111*a*. According to the embodiment, the ends 113*a* and 113*b* of the leaf spring project beyond the cover part 111*a* in a relaxed state of the leaf spring 113. However, this is not an essential feature, but the leaf spring can also be located such that its ends are in abutment against the underside of the cover part in the relaxed state. The leaf spring corresponds to a spring element according to the invention.

The central portion of the leaf spring 113 is in abutment against a spring support element 117 extending substantially parallel to the cover part. In addition, a screw 115 is guided through a bore in the cover part 111*a*, in the spring 113 and in the spring support element 117. In the spring support element 117, the bore is configured as a threaded bore. An external thread of the screw 115 is engaged with the internal thread in the bore of the spring support element 117, defining the position of the spring support element 117. The spring support element 117 has a shape of a rectangular plate with the aforementioned threaded bore at the center. The head of the screw 115 is located on the upper side of the cover part 111*a* and is accessible through the grate 3 by means of a suitable tool when the locking element 11 is in the installed state. In addition to conventional screws with screw heads such as slotted, cross-slotted, hexagon socket, external hexagon socket or Torx heads, safety screws whose heads cannot be rotated by means of commercially available tools can also be used.

If the screw 115, which is an actuating element according to the invention, is now actuated by means of a suitable tool, the spring support element 117 is moved towards or away from the cover part 111*a*, depending on the direction of rotation of the screw 115. The leaf spring 113 is biased when the spring support element 117 moves towards the cover part 111*a*. An increasingly larger area of the underside of the leaf spring 113 thereby comes into abutment with the spring support element 117, and the ends 113*a*, 113*b* of the leaf spring 113 are displaced away from the cover part.

Side parts 111*b* and 111*c* of the C-profile serve as protection against rotation of the spring support element 117. Specifically, the spring support element 117 comes into abutment with at least one of the side walls 111*b* and 111*c* as soon as it rotates together with the screw 115. For reasons of weight and space, the side parts 111*b* and 111*c* are beveled so that they have almost an isosceles trapezoidal shape in a front view. This can be seen in FIG. 2.

As the abutment surface of the leaf spring 113 on the spring support element 117 increases, a spring rigidity of the parts not yet in abutment with the spring support element 117 becomes increasingly higher. Thus, the ends 113*a*, 113*b* of the leaf spring 113 increasingly push into the recesses 93 of the brackets 9 and, in addition, into the recesses 73 of the edge 7 or into the recesses 13 of the drainage channel 1 until a maximum possible bias is reached. According to the embodiment, this is the case when the upper side of the leaf spring 113 comes into abutment with the underside of the cover part 111*a*.

However, it is not necessarily required that the leaf spring reaches this maximum position. Namely, the bias to be achieved depends on the one hand on the length of the leaf spring and on the distance to be bridged to the recesses 93 in the brackets 9. It is therefore advantageously possible to arrange a stop in the form of one or more washers (not shown) around the screw 115 below the cover part 111*a*, so that the leaf spring 113 abuts against the underside of the cover part 111*a* via these washers.

As a result of the increased spring rigidity, it is extremely difficult to fold down the ends 113*a*, 113*b* of the leaf spring 113 in this state. Therefore, the grate 3 cannot be removed from the drainage channel 1 without auxiliary means when the leaf spring 113 is biased to the maximum. In addition to the grate 3, the edge 7 is also secured in a particularly advantageous manner, since its convex portion 71 is also pressed into the recess 13 of the drainage channel 1.

Another advantage is that the leaf spring 113 itself has a weakening in its central region due to the bore, which makes it susceptible to folding over, particularly at this point, if it is not biased so that it is in abutment against the underside of the cover part 111*a*. This described risk is addressed in that the leaf spring 113 must fully abut the spring support element 117 before the ends 113*a*, 113*b* of the leaf spring are folded over. However, this modifies the spring characteristic in such a way that folding over of the leaf spring 113 in its central region can be most certainly ruled out.

FIG. 5*a* and FIG. 5*b* show a modification of the locking element 11. In this modification of the locking element, parts identical to the components described so far are designated with the same reference signs, and only modified parts are assigned new reference signs. A repeated description of the components already explained is omitted.

According to the modification, a cover part 211*a*, side walls 211*b* and 211*c* and a spring support element 217 are made of plastic. Preferably, these parts are manufactured by an injection molding process. However, other known molding processes such as extrusion or 3D printing can also be used to manufacture these parts.

In contrast to the embodiment described with reference to FIGS. 1*a* to 4, the spring support element 217 has a thickening on its underside in its central region when viewed in cross section. On the one hand, the thickening increases the strength of the spring support element 217, and on the other hand, it serves to receive a nut 219 as a counterpart for the screw 115 in an embedded manner secured against rotation.

Furthermore, a collar 211*d* is formed on the underside of the cover part 211*a* in the region of the bore through which the screw 115 is guided. The collar 211*d* serves as a stop to limit a bias of the leaf spring 113. This is done in a similar manner as with the disks described above.

To remove the grate 3, the screw 115 is actuated in the opposite direction so that the spring support element 117, 217 moves away from the cover part 111*a*, 211*a*. As a result, the leaf spring 113 is released, its ends 113*a*, 113*b* come out of the recess 93 and the grate 3 can be removed together with the locking element 11.

The invention claimed is:

1. A locking element comprising a spring element kept between a cover element and a spring support element, wherein the spring support element is displaceable relative to the cover element by means of an actuating element, and displacement of the spring support element causes a movement of at least one end of the spring element relative to the cover element.

2. The locking element according to claim 1, wherein the cover element has a planar and elongated shape, and a main component of a moving direction of the at least one end of the spring element is parallel to a longitudinal direction of the cover element.

3. The locking element according to claim 1, wherein the spring element is a leaf spring which, on an underside of the leaf spring, is in abutment against the spring support element at least in a central region of the leaf spring, and, on an upper side of the leaf spring, is in abutment against the cover element in a region of ends of the leaf spring, or vice versa.

4. The locking element according to claim 1, further comprising two side walls, wherein the spring support element and the spring element are located between the two side walls which, when viewed in a longitudinal direction of the locking element seen together with the cover element correspond to a cross-section of a C-profile.

5. The locking element according to claim 4, wherein the spring support element is in abutment against the two side walls, whereby rotation of the spring support element is prevented.

6. The locking element according to claim 4, wherein at least one of the cover element, the side walls and the spring support element is formed of a plastic material.

7. The locking element according to claim 6, wherein the spring support element has a thickening on a side facing away from the spring element, and the actuating element is formed as a screw which is in thread engagement with a counterpart embedded in the spring support element in the region of the thickening.

8. The locking element according to claim 6, wherein a protrusion is formed on the side of the cover element facing the spring element, the protrusion serving as a stop for the spring element to limit a biasing force thereof.

9. The locking element according to claim 1, wherein the actuating element is formed as a screw which is in thread engagement with the spring support element, and the displacement of the spring support element is towards or away from the cover element and is effected by screwing in or unscrewing the screw.

10. A drainage system comprising a drainage channel body formed in a U-shape, when viewed in cross-section, with a bottom and two lateral walls as first and second legs of the U, wherein a lateral end of the first leg opposite from the bottom has a recess on a side of the first leg facing the second leg, which is defined as an inner side of the first leg, a grate in abutment with the lateral end and having, when viewed in cross-section, at one end a mounting bracket having a convex portion received in the recess of the channel body, and a locking element according to claim 1, wherein an end of the spring element is engaged with a recess formed by the convex portion on the inner side of the mounting bracket.

11. The drainage system according to claim 10, wherein the actuating element is spaced from a side of the grate facing the bottom of the drainage channel body by means of a gap.

12. The drainage system according to claim 10, further comprising an end edge provided at a lateral end of the drainage channel body and having a convex portion received in the recess of the drainage channel body, wherein the convex portion of the mounting bracket is received in a recess formed by the convex portion of the end edge on the inner side.

13. A method of attaching a grate to a drainage channel body having a recess at a lateral end of a leg on a side facing a second leg, which is defined as an inner side, comprising the steps of attaching an end edge to the lateral end of a leg by embracing the lateral end, wherein a convex portion of the end edge is engaged with the recess of the drainage channel body, providing a grate, the grate having a mounting bracket with a convex portion at one end, when viewed in cross-section, with a locking element according to claim 1, wherein an end of the spring element is engaged with a recess formed by the convex portion on the inner side of the mounting bracket, abutting the grate with the end edge, wherein the convex portion of the mounting bracket is received in a recess formed by the convex portion of the end edge on the inner side thereof, and actuating the actuating element to displace the spring support element relative to the cover element to press an end of the spring element into the recess formed on the inner side of the mounting bracket.

* * * * *